US008221301B2

(12) United States Patent
Yang

(10) Patent No.: US 8,221,301 B2
(45) Date of Patent: Jul. 17, 2012

(54) CENTRIFUGE HAVING AN ANGLE ADJUSTER AND CENTRIFUGING METHOD

(76) Inventor: Hyun-Jin Yang, Seoul (KR)

( * ) Notice: Subject to any disclaimer, the term of this patent is extended or adjusted under 35 U.S.C. 154(b) by 480 days.

(21) Appl. No.: 12/305,952

(22) PCT Filed: Apr. 30, 2007

(86) PCT No.: PCT/KR2007/002127

§ 371 (c)(1),
(2), (4) Date: Dec. 19, 2008

(87) PCT Pub. No.: WO2007/142408

PCT Pub. Date: Dec. 13, 2007

(65) Prior Publication Data

US 2009/0312169 A1 Dec. 17, 2009

(30) Foreign Application Priority Data

Jun. 8, 2006 (KR) ..... 10-2006-0051461
Nov. 10, 2006 (KR) ..... 10-2006-0111264

(51) Int. Cl.
*B04B 5/02* (2006.01)

(52) U.S. Cl. ..... 494/20; 494/37

(58) Field of Classification Search ..... 494/16, 494/17, 20, 21, 23, 27, 29, 30, 31, 33, 36, 494/60, 37; 422/72
See application file for complete search history.

(56) References Cited

U.S. PATENT DOCUMENTS 5,047,004 A * 9/1991 Wells ..... 494/17
5,178,602 A * 1/1993 Wells ..... 494/17
5,707,331 A * 1/1998 Wells et al. ..... 494/20
5,895,346 A * 4/1999 Wells et al. ..... 494/37
6,832,980 B2 * 12/2004 Hayasaka ..... 494/10
RE38,730 E * 4/2005 Wells et al. ..... 494/37
RE38,757 E * 7/2005 Wells et al. ..... 494/20
7,422,554 B2 * 9/2008 Moscone et al. ..... 494/20
2009/0312169 A1 * 12/2009 Yang ..... 494/9

FOREIGN PATENT DOCUMENTS

JP 2002-200441 A 7/2002
KR 10-1998-083729 A 12/1998

OTHER PUBLICATIONS

PCT International Search Report for PCT/KR2007/002127 dated Aug. 13, 2007.

* cited by examiner

*Primary Examiner* — Charles E Cooley
(74) *Attorney, Agent, or Firm* — Ladas & Parry LLP

(57) ABSTRACT

Provided are a centrifuge that rotates about a rotation axis to separate a material and a method of centrifugal separation. The container is coupled to the centrifuge to freely pivot upward and downward on a pivoting axis vertical to a rotation plane. The container has an opening at an upper end thereof and holds a material inside. An angle adjuster raises the central axis of the container beyond a perpendicular angle with the rotation axis while the centrifuge is rotating in order to arrange the opening of the container downward with respect to the rotation plane and point an end of the container opposite to the opening of the container upward with respect to the rotation plane, and allow a portion of layers formed during centrifugal separating to flow down through the opening.

12 Claims, 8 Drawing Sheets

CENTRIFUGE HAVING AN ANGLE ADJUSTER AND CENTRIFUGING METHOD

CROSS-REFERENCE TO RELATED PATENT APPLICATION

This application is a national phase of International Application No. PCT/KR2007/002127, entitled "CENTRIFUGE AND CENTRIFUGING METHOD", which was filed on Apr. 30, 2007, and which claims priority of Korean Patent Application No. 10-2006-0051461, filed on Jun. 8, 2006 and Korean Patent Application No. 10-2006-0111264, filed on Nov. 10, 2006, respectively, in the Korean Intellectual Property Office, the disclosure of which is incorporated herein in its entirety by reference.

BACKGROUND OF THE INVENTION

1. Field of the Invention

The present invention relates to a centrifuge and a centrifuging method, and more particularly, to a centrifuge and a centrifuging method capable of performing centrifugal separating while simultaneously placing the opening of a container to face downward by rotating the container about a pivoting axis by more that 90° so that accurate and easy recovery of material can be performed.

According to the present invention, the angle of the container and the rotating speed are adjusted during centrifugal separation, so that materials in the upper layers with comparatively less fluid resistance and specific gravity can fall from the container due to gravity, and materials in lower layers with comparatively more fluid resistance and weight remain in the container. Thus, the centrifuge and centrifuging method according to the present invention may be used for all liquid and solid materials that can fall from a downwardly sloped surface due to gravity, such as liquids, powders, jelly, liquid and solid compounds, colloids, and nearly spherical solids.

2. Description of the Related Art

A centrifuge is an apparatus that spins different materials so that they separate by centrifugal force. In biotechnology, centrifuges are used to separate cells mixed in a liquid or materials having higher specific gravity and adhesiveness than a liquid by differences in specific gravity. Centrifuges may be divided according to the amount of samples to be centrifugally separated, rotation speed, rotor type, and many other factors.

In biotechnology, when centrifugal separating is used to separate a material including a compound liquid (fluid) such as blood (the liquid containing a fine solid or semisolid material,), the fluid is separated into a plurality of layers according to the specific gravity of its components. Each layer that is separated by centrifugal force is stacked in a container, and the separation of the layers must generally be performed manually.

The separation of centrifugally separated liquid layers requires not only an extensive amount of work, but the purity of the separated materials is low, and the separated material can be damaged.

In an attempt to overcome these problems, the material with the highest specific gravity is deposited on the outer wall of the rotor by spinning a cylindrical rotor, after which the material is separated by mechanical means. However, this method cannot be used under general circumstances. That is, this separation method can be used only when the quantity of the material to be separated can cover the entire outer wall of the rotor. Additionally, it is difficult to distinguish between centrifuged layers accumulated on the wall in one dimension. For example, when a small quantity of around 0.01 ml of a cell sample must be separated, the above method is not appropriate.

Sewage treatment plants use continuous centrifuges having a funnel shape and using both the specific gravity and fluid resistance of liquids. However, this type of centrifuge is not suitable for use in the biotech experiments. In a biotech lab, a test material is placed in a container and separated centrifugally. Thus, the centrifuge must be capable of separating a small quantity of material without damaging it.

Because centrifuges used in biotechnology must be able to separate human cells without damaging them, they generally use a weaker centrifugal force than that used for other types of materials. The maximum amount of centrifugal force used for separating cells is 100G and the actual amount used is generally lower. G indicates a gravitational constant, which is a unit used to describe the capacity of a centrifuge since the centrifugal force generated by a centrifuge is similar to the gravitational force.

When cells are separated in a centrifuge, the separated layers are visually discernible, but it is difficult to physically separate them. Because the layer directly above a layer of cells is water, when a container is slowly tilted to discard the layer of water above the cells, some of the cells that have been centrifugally separated are washed out because the cells on the bottom layer tend to flow with the movement of water. If no centrifugal force is applied, because the cohesiveness and adhesiveness between cells are not very different from the characteristics of water, separating the upper layer of water has a 50% failure rate. Even when the separation is successful, it is not unusual for a portion of cells from the uppermost layer to be washed out. If more centrifugal force is used to press the cells tightly together, the cells can be damaged.

To prevent the above problems from occurring, many technicians employ a pipette to remove the upper layer; however, this requires performing 7-8 times of dilution for cleaning the remaining liquid material.

SUMMARY OF THE INVENTION

The present invention provides a centrifuge and a centrifuging method capable of adjusting the amount of gravitational force and centrifugal force applied to a material to be separated centrifugally, and precisely and easily dividing and separating layers of centrifugally separated material.

The centrifuge and the centrifuging method of the present invention control the amount of gravity and centrifugal force applied to the respective separated layers of material by adjusting the angle of the container and the rotating speed during centrifugal separation, so that each layer can be divided and recovered.

The centrifuge of the present invention is an apparatus for centrifugally separating materials including liquids (fluids) including fine solid particles or semi-solids such as jelly, polymers and other materials.

The centrifuge and the centrifuging method according to the present invention may be used for all liquid and solid materials that can fall from a downwardly sloped surface due to gravity, such as liquids, powders, jelly, liquid and solid compounds, colloids, and nearly spherical solids.

The centrifuge of the present invention may have a container coupled to be capable of pivoting upward and downward with respect to a rotation plane perpendicular to a rotating axis. The container holds material to be separated within and has an opening formed at the top thereof. When the container is rotated, the angle of the lengthwise axis of the container varies with respect to the rotation plane perpendicular to the rotating axis.

In the centrifuge of the present invention, the angle adjuster adjusts the pivoting angle of the container. When the centrifuge rotates and performs centrifugal separation, materials with higher specific gravities and fluid resistance (complex flow resistance from characteristics such as adhesiveness, cohesiveness and viscosity; hereinafter referred to as "anti-flow force") that are formed of larger materials are disposed further away from the center of the rotation axis, and materials with less specific gravity and fluid resistance are disposed closer to the center of the rotation axis.

During the rotation of the centrifuge, when the pivoting angle of the container is adjusted so that the opening faces downward, fluids with less specific gravity and fluid resistance flow downward due to gravity. Also, if the rotation speed is controlled together with the pivoting angle of the container to adjust the amount of centrifugal force applied to the materials that have been centrifugally separated within the container, each layer of centrifugally separated material can be selectively discharged from the container.

According to an aspect of the present invention, there is provided a centrifuge rotating about a rotation axis to separate a material, including: a container coupled to the centrifuge to freely pivot upward and downward on a pivoting axis vertical to a rotation plane, the container defining an opening at an upper end thereof and holding a material inside; and an angle adjuster raising a central axis of the container beyond a perpendicular angle with the rotation axis while the centrifuge rotates, in order to arrange the opening of the container downward with respect to the rotation plane and point an end of the container opposite to the opening upward with respect to the rotation plane, allowing a portion of layers formed during centrifugal separation to flow down through the opening.

In the centrifuge of the present invention, after the layer separation is completed during the rotation of the centrifuge, the angle and rotation speed of the container are adjusted so that centrifugal force is applied differently on each of the layers, allowing for a complete recovery of the material required. That is, the centrifuge and the centrifuging method of the present invention allows material with less specific gravity and fluid resistance to be discharged from the container due to gravity, and the material with greater specific gravity and fluid resistance to remain in the container. Thus, centrifugal separation is achieved and a large lower layer of material remains in the container. Thus, by performing centrifugal separation, and continually applying centrifugal force, centrifugal separating can occur while simultaneously disposing the opening of a container to face downward by raising the container about a pivoting axis by more than 90° so that accurate and easy recovery of the material can be performed.

The centrifuge may further include a rotation controller controlling the rotation speed of the rotor.

The angle adjuster may apply an external force to the container through magnetism to adjust an angle of the container.

The angle adjuster may include a driving unit forcibly pivoting the pivoting axis of the container.

The end of the container opposite to the opening may have a conical shape.

According to another aspect of the present invention, there is provided a centrifuge including: a rotor rotating about a rotation axis; a container coupled to the rotor to freely pivot upward and downward on a pivoting axis perpendicular to a rotation plane, the container having an opening at an upper end thereof and holding a material inside; and an angle adjuster raising a central axis of the container beyond a perpendicular angle with the rotation axis or lowering the central axis from the raised position while the rotor rotates, in order to arrange the opening of the container downward with respect to the rotation plane and point an end of the container opposite to the opening upward with respect to the rotation plane, for allowing a portion of layers formed during centrifugal separation to flow down through the opening.

The centrifuge may further include a rotation controller controlling a rotation speed of the rotor.

The centrifuge may further include a holding portion to hold material flowing down from the opening of the container.

According to a further aspect of the present invention, there is provided a method of centrifugal separation, including: providing a material within a container capable of pivoting freely upward and downward with respect to a rotation plane perpendicular to a rotation axis; centrifugally separating the material by rotating the rotation axis at a first speed; adjusting an angle between a central axis of the container and the rotation axis to be between 90° and 180° while the rotation axis is rotating, such that an opening of the container faces downward with respect to the rotation plane, and an end opposite to the opening faces upward with respect to the rotation plane; reducing the rotating speed from the first speed to a second speed, and discharging a portion of layers of material centrifugally separated within the container through the opening; discontinuing the adjusting of the angle between the central axis and the rotation axis, and restoring an original angle between the central axis and the rotation axis through a weight of the container; and stopping the rotation of the rotation axis.

The discharging of the material may further include loading material discharged from the opening into a holding portion.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The present invention will now be described more fully with reference to the accompanying drawings, in which exemplary embodiments of the invention are shown.

Figure 1:
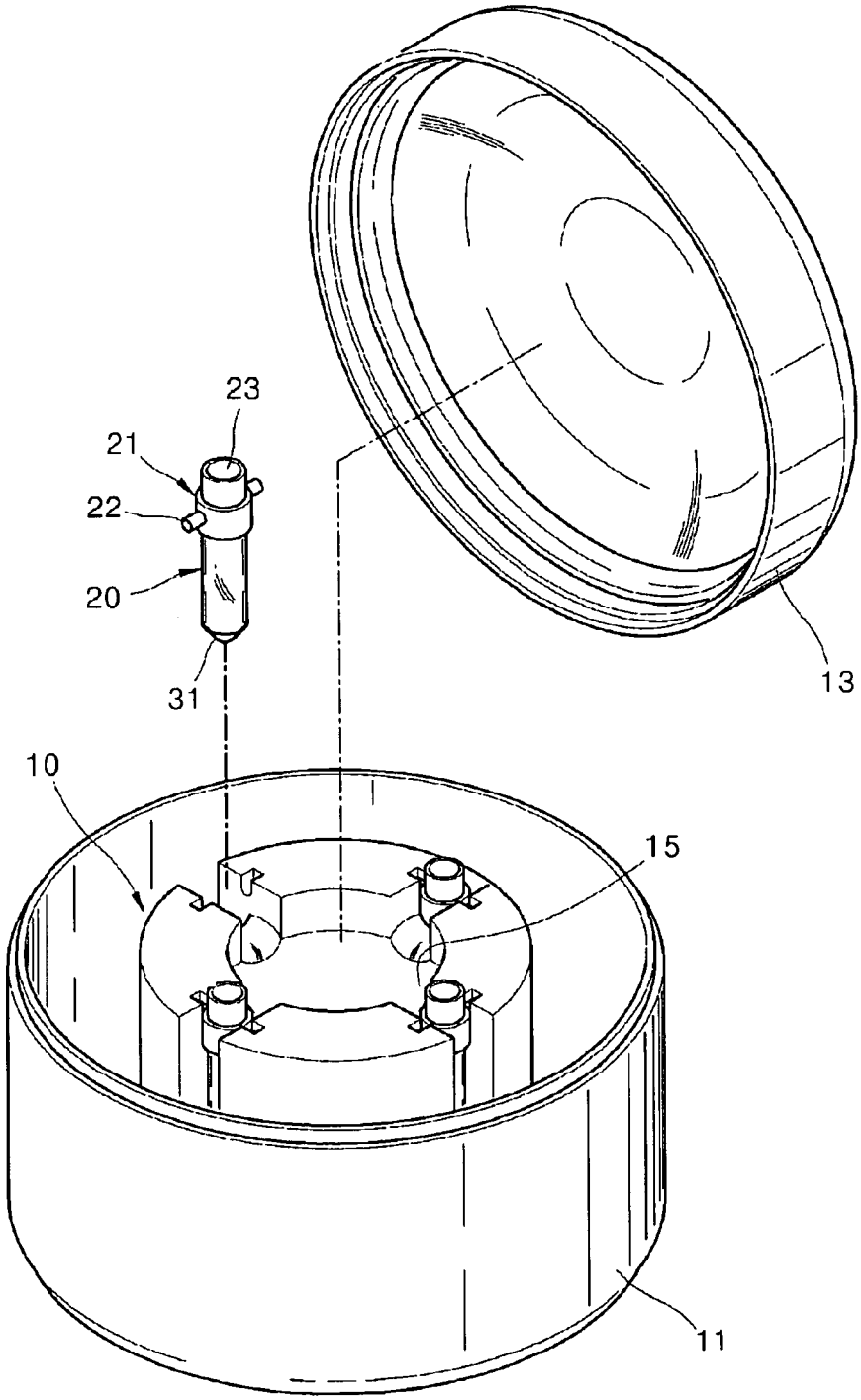
FIG. 1 is a perspective view of a centrifuge according to an embodiment of the present invention.
Figure 2:
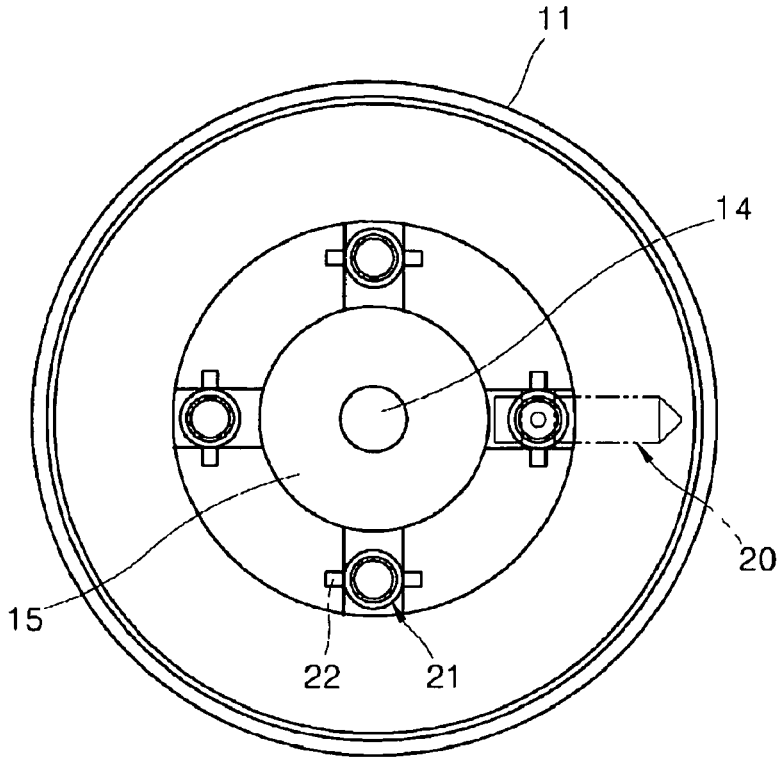
FIG. 2 is a plan view of the centrifuge in FIG. 1.
Figure 3:
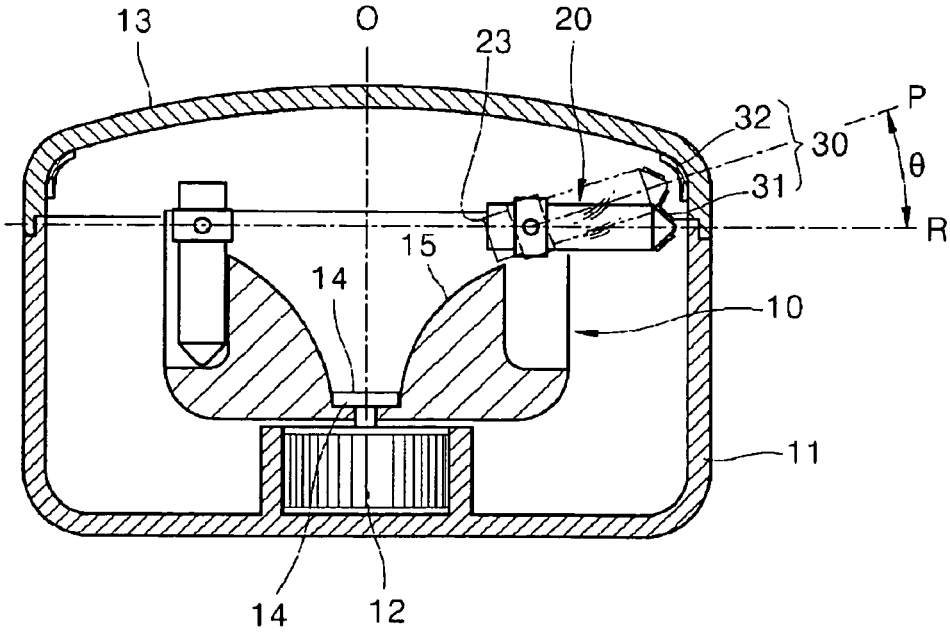
FIG. 3 is a cross-sectional side view of the centrifuge in FIG. 1.

FIG. 1 is a perspective view of a centrifuge according to an embodiment of the present invention, FIG. 2 is a plan view of the centrifuge in FIG. 1, and FIG. 3 is a cross-sectional side view of the centrifuge in FIG. 1.

A centrifuge according to the embodiment illustrated in FIGS. 1 through 3 is an apparatus that spins about a rotation axis 14 to separate materials. The centrifuge of the present embodiment includes a rotor 10, a container 20 pivotably coupled to the rotor 10, and an angle adjuster 30 that adjusts the rotation angle of the container 20.

The rotor 10 rotates about the rotation axis 14, and supports the container 20. The rotor 10 is disposed within a casing 11, and is coupled to a drive motor 12 to rotate within the casing 11 and perform centrifugal separation. The centrifuge also includes a rotation controller (not shown) that controls the rotation speed of the rotor 10. That is, the rotation controller controls the drive motor 12 in order to control the rotation speed of the rotor 10 according to the stage of centrifugal separation being performed.

At the upper end of the rotor 10, a plurality of containers 20 is pivotably coupled to the rotor 10. The containers 20 are coupled to be capable of pivoting upward or downward with respect to a rotation plane (R) perpendicular to a center (O) of the rotation axis 14. When the container 20 is pivoted upward or downward with respect to the rotation plane (R), a rotation angle (θ) of an axis (P) in a lengthwise direction of the container 20 with respect to the rotation plane (R) may change.

Although the container 20 may have a pivoting axis mounted on the outside thereof in order to be pivotably coupled directly to the rotor 10, in the present embodiment, a pivoting holder 21 is interposed in the coupling between the container 20 and the rotor 10. The pivoting holder 21 has a pivot axis 22 arranged on either side thereof, and the pivot axes 22 are seated in recesses formed in the upper surface of the rotor 10 so that the rotor 10 supports the container 20. Accordingly, the container 20 can pivot upward and downward with respect to the rotor 10.

The container 20 may be in the form of a general test tube for holding a material to be centrifuged. An opening 23 is formed at the top of the container 20, and the end opposite the opening 23 may have a circular cone shape.

The container 20 in the present embodiment is able to freely pivot with respect to the rotor 10, so that as the rotation speed of the rotor 10 increases, the container 20 is pivoted upward by centrifugal force to rotate. When the rotation speed of the rotor 10 becomes sufficiently large, the direction in which the container 20 points is horizontal (the same direction as that of the centrifugal force), and when the rotation speed of the rotor 10 is reduced, the container 20 pivots downward. If an angle adjuster 30 (described below) were not present, the pivoting angle (θ) of the container 20 would be determined by the amount of centrifugal force applied thereto.

The angle adjuster 30 adjusts the pivoting angle (θ) of the container 20 with respect to the rotation plane (R). The angle adjuster 30 adjusts the pivoting angle (θ) of the container 20 so that the opening 23 of the container 20 points downward with respect to the rotation plane (R), thereby allowing liquid layers with a low specific gravity and a low fluid resistance from material that has been centrifugally separated to flow downward through the opening of the container.

When the centrifuge does not operate, the closed end of the container 20 points downward. In this case, when the pivoting angle (θ) of the lengthwise axis (P) of the container 20 with respect to the rotation plane (R) is 0, the pivoting angle (θ) when the container 20 is at the same level with the rotation plane (R) is 90°. The angle adjuster 30 is capable of adjusting and maintaining the pivoting angle (θ) of the container 20 at more that 90° when the centrifuge is rotating or even when the centrifuge stops. In FIG. 3, the pivoting angle (θ) is depicted with respect to the rotation plane (R) for the sake of convenience; however, in accordance with the above description, the pivoting angle (θ) is 0° when the container 20 is disposed downward.

Even when the rotation speed of the rotor 10 is decreased so that the centrifugal force on the container 20 is reduced, the angle adjuster 30 is able to maintain the pivoting angle (θ) of the container 20 at a predetermined angle with respect to the rotation plane (R).

The angle adjuster 30 of the present embodiment includes a first magnet 31 installed at the tip of the container 20, and a second magnet 32 installed on an inner surface of a cover 13 of the rotor 10. The first magnet 31 may be a permanent magnet or made of a metal material, and the second magnet 32 may be an electromagnet. When the rotation speed of the rotor 10 increases and the position of the container 20 becomes horizontal, a current flows through the second magnet 32 (which is an electromagnet) and thus the first magnet 31 is attracted toward the second magnet 32. When the first magnet 31 is attracted toward the second magnet 32, the tip of the container 20 points upward with respect to the rotation plane (R), and the opening 23 is points downward with respect to the rotation plane (R), so that the opening 23 is opened downward from a horizontal position toward the center (O) of the rotation axis 14.

As described above, the angle adjuster 30 raises the container 20 past a horizontal axis thereof so that a portion of layers separated centrifugally can flow out through the opening 23.

A holding portion 15 is formed within the rotor 10. The holding portion 15 is able to hold material that flows out from the opening 23 of the container 20. The holding portion 15 is formed so that liquid can flow downward by gravity, with a sectional width that slopes and narrows from the top to the bottom. As shown in FIG. 3, the wall of the holding portion 15 may be curved inward. As shown in the horizontal section illustrated in FIG. 2, the holding portion 15 is circularly formed. Alternately, taking into consideration the effect that centrifugal force generated from the rotation of the rotor 10 has on the flow of fluids along the inner wall of the rotor 10, the horizontal section of the holding portion 15 may be formed in the shape of two combined arcs having the same center.

The operation of the above-structured centrifuge will now be described.

After the container 20, in which a material (sample) to be centrifugally separated is placed, is inserted in the pivoting holders 21 to install the container 20 on the rotor 10, when the centrifuge 20 is operated, the drive motor 12 rotates the rotor 10. The container 20 is connected via the pivoting holder 21 to pivot freely upward and downward on the rotor 10, and the amount of centrifugal force applied to the container 20 increases with the gradual increase of the rotation speed of the rotor 10, so that the pivoting angle (θ) of the container 20 with respect to the rotation plane (R) decreases.

When the rotation speed of the rotor 10 becomes sufficiently large, the container 20 is maintained perpendicular to the center 0 of the rotation axis 14, in line with the rotation plane. If the rotor 10 continues to rotate in this state, centrifugal separation of the material within the container 20 is performed according to specific gravities of material layers. The rotation speed at which the centrifugal separation occurs will be referred to as the "first speed".

When the material is separated into a plurality of layers through centrifugal separation, layers with greater specific gravity and greater fluid resistance are disposed further away from the center (O) of the rotation axis, and layers with less specific gravity and less fluid resistance are disposed closer to the center (O) of the rotation axis.

When the electromagnetic second magnet 32 operates, the second magnet 32 attracts the first magnet 31. Thus, the end of the container 20 pivots further in an upward direction with respect to the rotation plane (R), so that the opening 23 of the container 20 slopes downward toward the center (O) of the rotation axis, and the container 20 is inclined higher than the rotation plane (R).

If the rotation speed of the rotor 10 is decreased, the amount of centrifugal force decreases, but the opening 23 of the container 20 may retain its downward slant toward the center (O) of the rotation axis due to the interaction between the first and second magnets 31 and 32. In this condition, because centrifugal force and gravity act in opposite directions for the fluid within the container 20, fluid with the lowest specific gravity begins flowing toward the center (O) of the rotation axis. The fluid that flows into the holding portion 15 of the rotor 10 flows toward the bottom of the rotor 10 along its inner walls due to combined gravitational and centrifugal forces acting thereupon. A speed at which the rotor 10 rotates after the first speed is reduced is referred to as the "second speed".

Thus, by controlling the centrifugal force acting on the material to be separated within the container by controlling the pivoted angle of the container 20 and the rotation speed of the rotor 10, the critical points for discharging respective centrifugally separated material layers from the container 20 may be selected. Accordingly, after centrifugal separation, each of the centrifugally separated layers formed within the container 20 may selectively be discharged to the outside of the container by setting a tilt angle and rotation speed of the container 20 and rotor 10.

After the fluid from the highest layer composed mostly of water drains entirely into the rotor 10, the operation of the second magnet 32 is discontinued and the rotation speed of the rotor 10 is reduced to stop the centrifuge. Because the highest layer of fluid was drained into the holding portion 15 of the rotor 10 during centrifuging, stem cells and similar materials with large specific gravities remain in the container 20. Since the container 20 can easily be separated from the centrifuge, a required material can easily be obtained after centrifuging without having to perform an additional process of separating layers that have been centrifugally separated according to specific gravities.

Figure 4:
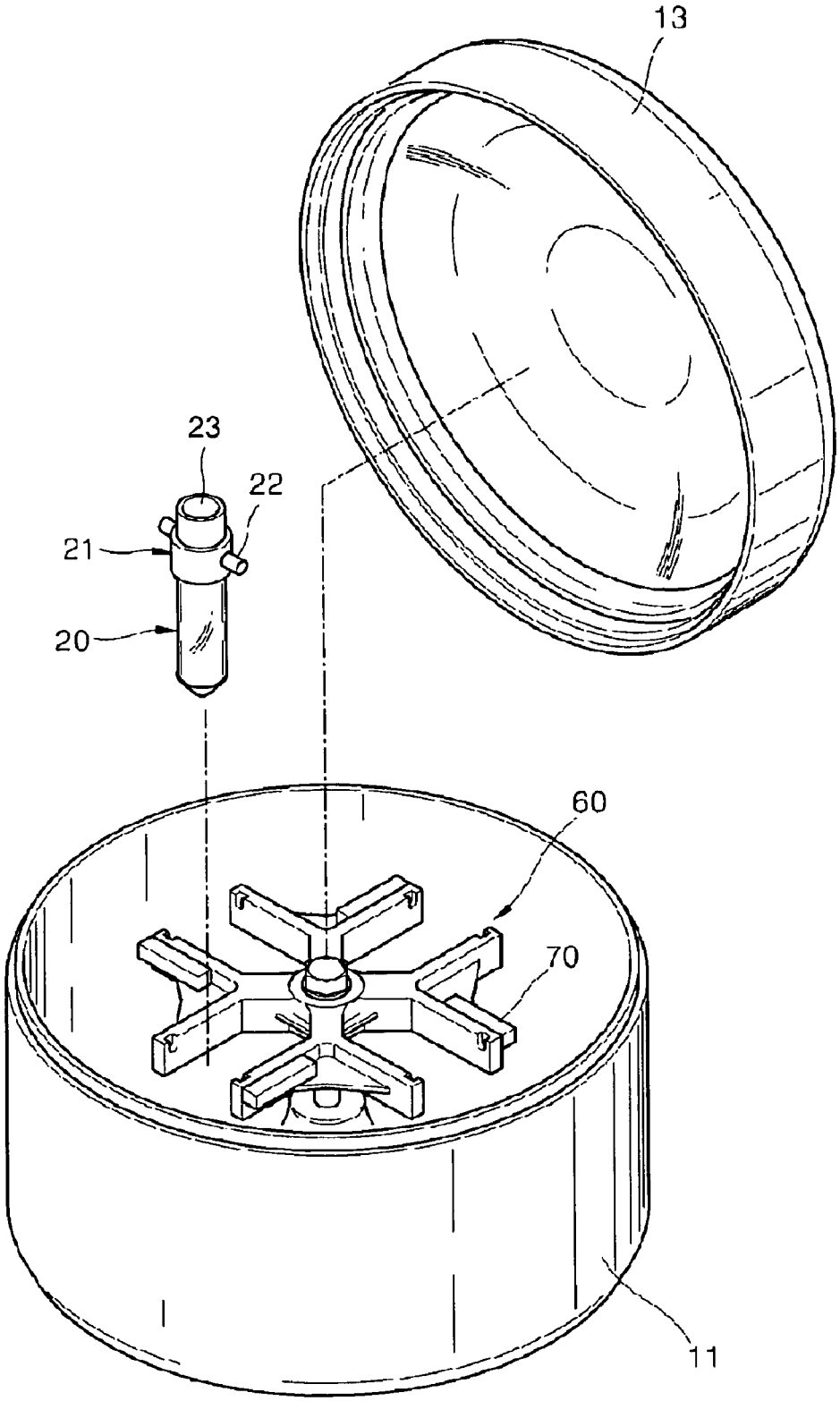
FIG. 4 is a perspective view of a centrifuge according to another embodiment of the present invention.
Figure 5:
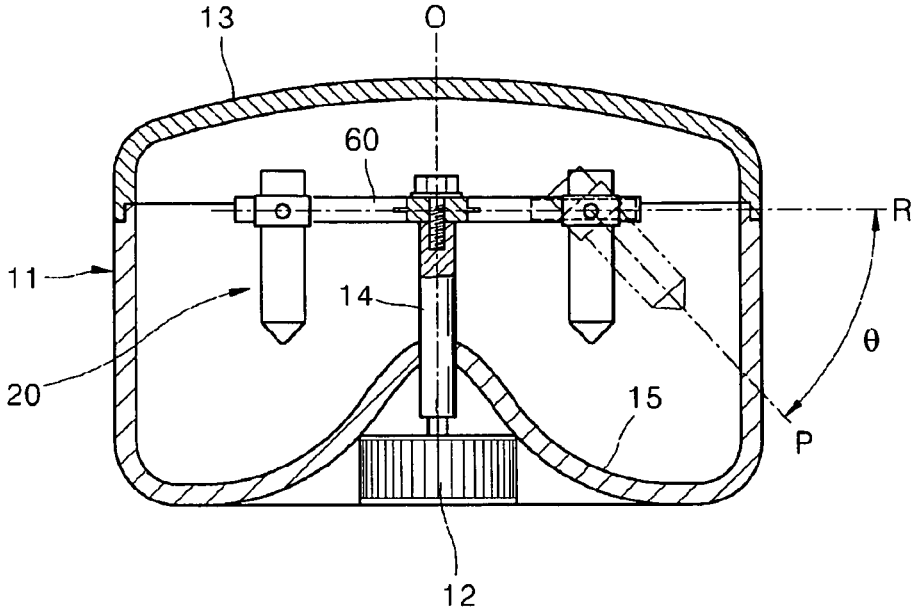
FIG. 5 is a cross-sectional side view of the centrifuge in FIG. 4.

FIG. 4 is a perspective view of a centrifuge according to another embodiment of the present invention, and FIG. 5 is a cross-sectional side view of the centrifuge in FIG. 4

The centrifuge according to the embodiment illustrated in FIGS. 4 and 5 rotates about a rotation axis 14 to separate a material and includes a plurality of containers 20 and an angle adjuster 70 that adjusts a pivoting angle (θ) of the containers 20.

A rotor 60 that rotates about the central rotation axis 14 supports the containers 20. The rotor 60 is held within a casing 11, and is rotated by a drive motor 12 to perform centrifugal separating within the casing 11. A holding portion 15 is formed at the bottom of the casing 11. The holding portion 15 holds material that flows out from an opening 23 of the container 20.

The plurality of containers 20 is coupled at the upper end of the rotor 60 to be capable of pivoting with respect to the rotor 60. The containers 20 are capable of being pivoted upward and downward with respect to a rotation plane (R) that is horizontal from a center (O) of the rotation axis 14. By pivoting the containers 20 upward and downward with respect to the rotation plane (R), a pivoting angle (θ) between a lengthwise axis (P) of the container 20 and the rotation plane (R) may be varied.

Although the containers 20 may be directly coupled to the rotor 60, in the present embodiment, the container 20 has a pivoting holder 21 in order to be coupled to the rotor 60. The pivoting holder 21 has pivoting axes 22 formed on either side thereof, and the pivoting axes 22 are seated in recesses formed at the upper end of the rotor 60 so that the rotor 60 can support the containers 20. Thus, the containers 20 can be pivoted upward and downward with respect to the rotor 60.

The container 20 may be a conventional test tube that holds a material to be centrifugally separated inside. An opening 23 is formed at the top of the container 20, and the end opposite to the opening 23 may be formed in a circular cone shape.

Because the container 20 is able to pivot freely about the rotor 60, when the rotor 60 attains a sufficient rotation speed, the container 20 rises to a horizontal plane that is in line with the direction of centrifugal force. When the rotation speed of the rotor 60 decreases, the container 20 pivots downward. When the angle adjuster 70 (to be described below) does not operate, the pivoting angle (θ) of the container 20 is defined by the free pivoting of the container 20 according to the applied centrifugal force.

The angle adjuster 70 adjusts the pivoting angle (θ) of the container 20 with respect to the rotation plane (R). The angle adjuster 70 adjusts the pivoting angle (θ) of the container 20, such that the opening 23 of the container 20 tilts downward with respect to the rotation plane (R), so that a fluid layer from centrifugally separated material that has a lower specific gravity and fluid resistance can flow out through the opening 23 of the container 20.

If the pivoting angle (θ) of the container 20 is 0° when the centrifuge is stopped and the container 20 is positioned in a downward direction, then, the pivoting angle (θ) becomes 90° when the container 20 is in line with the rotation plane (R). The angle adjuster 70 may adjust and maintain the pivoting angle (θ) of the container 20 at an angle beyond 90° when the centrifuge is rotating and even when it is still. FIG. 5 illustrates the pivoting angle (θ) in relation to the rotation plane (R); however, as described above, the pivoting angle (θ) is described when the container 20 is in a downwardly pointing position.

The angle adjuster 70 is able to maintain the pivoting angle (θ) of the container 20 with respect to the rotation plane (R) when the rotation speed of the rotor 60 is reduced and the centrifugal force applied to the container 20 is reduced.

The angle adjuster 70 in the present embodiment operates based on magnetic interaction to adjust the pivoting angle (θ) of the container 20. The adjuster 70 is formed of an electromagnet that applies a magnetic force on the pivoting axes 22 of the pivoting holder 21. By adjusting the strength of the magnetic force, the pivoting angle (θ) of the container 20 may be adjusted.

Figure 6:
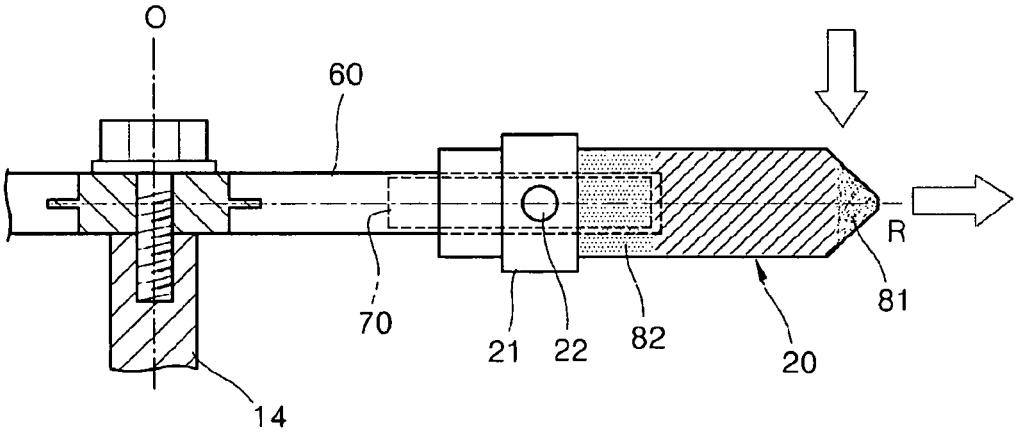
FIG. 6 is a partial side view illustrating the centrifuge in FIG. 4 being used.
Figure 7:
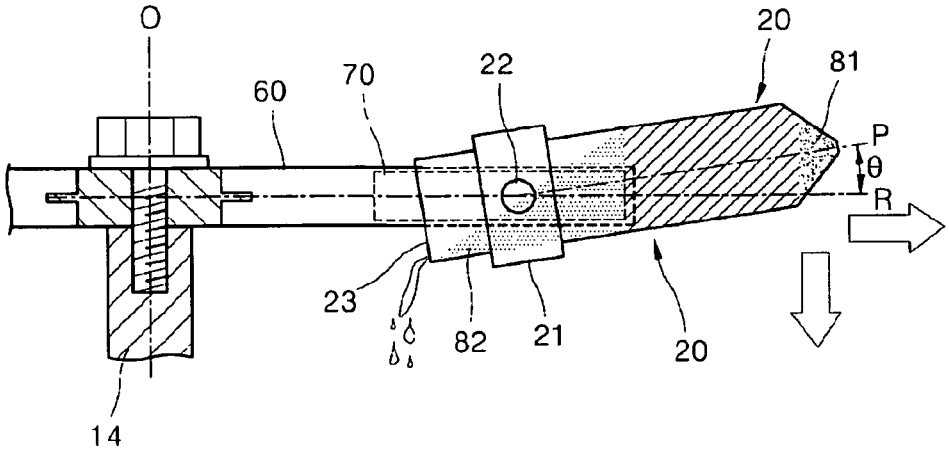
FIG. 7 is a partial side view illustrating an angle adjuster of the centrifuge in FIG. 6 in operation.

FIG. 6 is a partial side view illustrating the centrifuge in FIG. 4 in operation, and FIG. 7 is a partial side view illustrating an angle adjuster of the centrifuge in FIG. 6 in operation.

By adjusting the pivoting angle (θ) of the container 20 with respect to the rotation plane (R), the angle adjuster 70 can pivot the container 20 upward and downward with respect to the rotor 60. While the centrifuge rotates at a sufficient rotation speed and when no magnetic force is applied by the angle adjuster 70 to the container 20 supported by the pivoting holder 21 on the pivoting axes 22, the container 20 is positioned horizontally in line with the direction of centrifugal force, as shown in FIG. 6. A first material 81 with a high specific gravity and a high fluid resistance reaches a position farther away from the center (O) of the rotation axis at the outer portion within the container 20. A second material 82 with a low specific gravity and a low fluid resistance is situated closer to the center (O) of the rotation axis.

FIG. 7 illustrates the position of the container 20 when the rotation speed of the rotor 60 is lowered, and the pivoting angle of the container 20 is adjusted by activating the angle adjustor 70. In this case, because a combination of centrifugal force and gravity acts upon a liquid within the container 20, the second material 82 with the lowest specific gravity may be discharged to the outside through the opening 23.

A camera (not shown), for taking an image of the flow of fluid within the container 20, may be installed on the rotor 60. Thus, when the centrifuge is operated and the rotor 60 rotates, the centrifugal process occurring within the container 20 can be viewed from the outside, so that when centrifuging is completed, the angle adjuster 70 may be activated to change the balance between gravity and centrifugal force acting within the container 20 by adjusting the pivoting angle of the container 20.

The centrifuge of the present embodiment may be used for all liquid and solid materials including liquids, powders, jelly, liquid and solid mixtures, colloids, and solids close to spheres in shape, which are capable of moving downward through gravity along a declined surface.

Because such materials, even in small quantities, are capable of contacting and flowing along inner walls of the container 20, they are affected by friction. When the rotor 10 is rotating to apply centrifugal force on materials within the container 20, if a slope of the inner surface of the container 20 is formed with respect to gravity through pivoting the container 20, the material inside the container 20 is acted upon by gravity and centrifugal force. When the rotation speed of the rotor 10 is reduced so that the amount of centrifugal force is also reduced, the conditions for allowing the material to flow down along the sloped surface by gravity are satisfied; however, because there is a resistance on the downward flow of material, the point at which a material begins to flow downward may differ according to the type of material.

If there is no resistance, when the gravitational and centrifugal forces acting on a material are the same, the material does not flow and retains its current equilibrium. However, in reality, friction acts as resistance against fluid, and thus must be taken into consideration.

Figure 8:
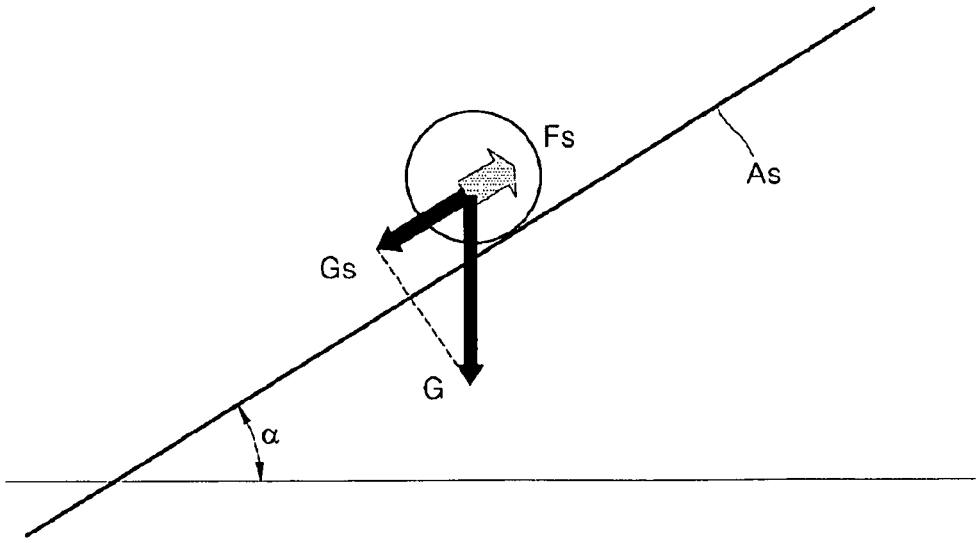
FIG. 8 is a schematic diagram illustrating forces applied in a container without considering the centrifugal force according to an embodiment of the present invention.

FIG. 8 is a schematic diagram illustrating the applied force within a container without considering a centrifugal force applied thereto according to an embodiment of the present invention.

FIG. 8 schematically illustrates an angle α formed by a container and a horizontal surface that forms a sloped surface (As) with respect to gravity. In the case of FIG. 8, the centrifuge does not rotate so that no centrifugal force is generated. Thus, only gravity (G) affects the material, and a component (Gs) of gravity (G) along the sloped surface (As) acts on the material to make it flow downward along the sloped surface. Also, friction (Fs) that is fluid resistance applied between the material and the sloped surface (As) of the container acts in a direction opposite to the flow direction of the material, so that it impedes the downward flow of the material.

Figure 9A:
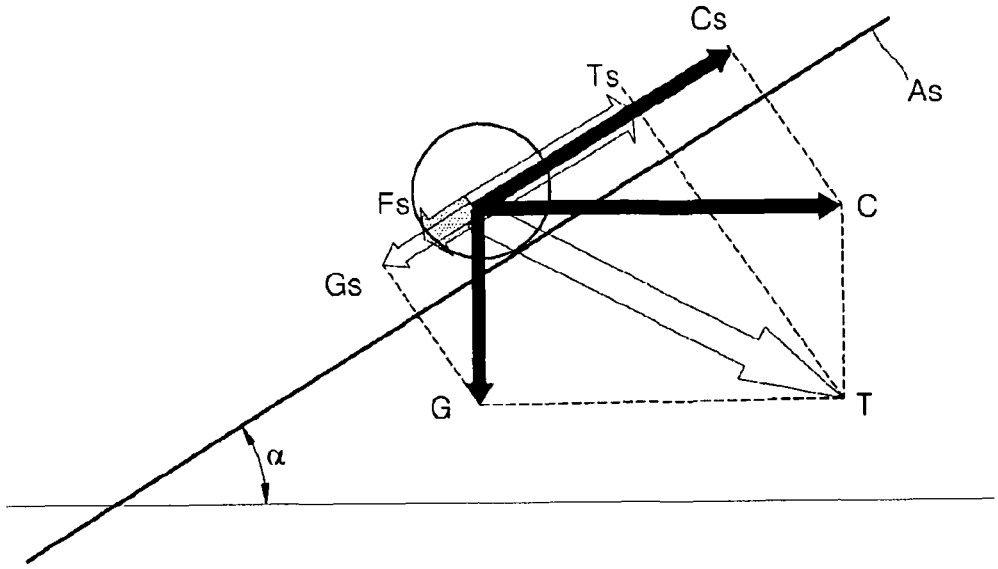
FIG. 9*a* is a schematic diagram illustrating changes to the forces in FIG. 8.

FIG. 9*a* is a schematic diagram illustrating changes to the forces in FIG. 8.

When the rotor rotates, the centrifugal force acts on a material. The centrifugal force (C) acts in a horizontal direction to generate a force (Cs) that pushes the flow of material in an upward direction on the sloped surface. The material is acted upon by a combined force (T) of the centrifugal force (C) and gravity (G), and is pressed against the sloped surface (As). The amount of centrifugal force (C) shown is greater than the amount of gravity (G). Thus, the force (Ts) on the sloped surface of the combined force (T) acting on the material presses upward against the material, and when the force (Ts) on the sloped surface is greater than the friction (Fs), the material moves in an upward direction along the sloped surface.

In order to allow the material to flow downward, the rotation speed of the rotor is further reduced to reduce the centrifugal force (C), and the sloped surface (As) is further inclined so that the gravity (Gs) on the sloped surface increases.

Figure 9B:
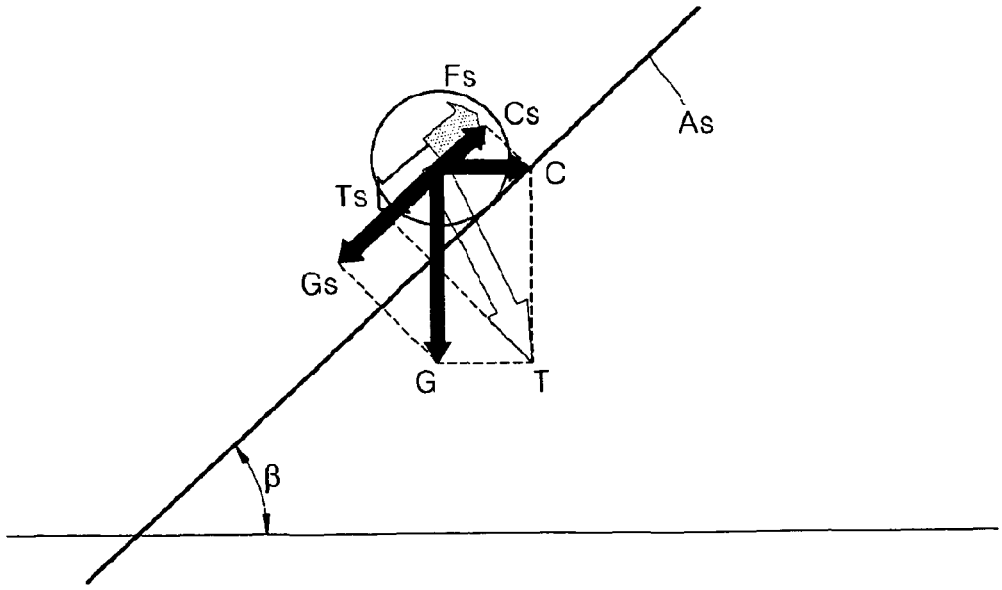
FIG. 9*b* is a schematic diagram illustrating changes to the forces in FIG. 9*a;*

FIG. 9*b* is a schematic diagram illustrating changes to the forces in FIG. 9*a* when the container is further tilted and the centrifugal force is reduced.

Referring to FIG. 9*b*, the sloped surface (As) forms an angle β with the horizontal surface, when the slope is steeper (β>α), and the gravity (Gs) on the sloped surface is greater. At the same time, the rotation speed of the rotor is reduced to reduce the centrifugal force (C), so that the force (Cs) of the centrifugal force on the sloped surface is reduced. Accordingly, the force (Ts) on the sloped surface of the combined force (T) of gravity (G) and centrifugal force (C) acts on the material to make it flow downward. When the rotation speed of the rotor is reduced so that the centrifugal force (C) is less than the gravity (G), the material is able to flow downward along the sloped surface; however, the friction (Fs) that is the fluid resistance acting between the material and the inner wall surface of the container impedes the downward flow of the material. That is, the combination of the centrifugal force (C) on the sloped surface (Cs) and friction (Fs) acts against the gravity (Gs) on the sloped. Thus, when the force (Ts) on the sloped surface is greater than the friction (Fs) acting as resistance, the material can flow downward.

As described above, there are two variables that affect the flow of material in a downward direction.

First, there are gravitational and centrifugal forces that are variables related to specific gravity. With the same rotation speed of the rotor, centrifugal force is stronger at locations radially farther from the center of rotation. Thus, as the rotation speed of the rotor is reduced and the flow of material is monitored, a material nearest to the rotation axis flows first. Because materials with higher specific gravities are located farther away from the rotation axis, the point at which the materials with higher specific gravities begin to flow is delayed more than that of materials that are closer to the rotation axis. Accordingly, it is easier to obtain materials with greater specific gravities. Hereinafter, a force generated by gravity and centrifugal force pressing a material upward is called 'a rising force'. The material flows upward or downward along the sloped surface according to the amount of the rising force.

Second, friction is another variable of flow resistance of a fluid. A force that impedes the tendency of a liquid to flow down a sloped surface is determined by many variables. Representative examples of such variables for fluids include viscosity and cohesiveness (surface tension), movability and friction (in the case of solids), and adhesiveness (in the case of gels). These forces may be generally described as the friction force. A combination of these forces may be referred to as 'an anti-flow force' or 'an anti-falling force'.

The centrifuge of the present invention can easily separate materials with a high specific gravity and anti-flow force from materials that do not have a high specific gravity and anti-flow force. Especially, when cells should be obtained, because cells satisfy both conditions of a high specific gravity and anti-flow force, they can easily be separated.

During centrifugal separation, the fluid at the uppermost level in a container 20 is discharged to the holding portion 15, so that only material with a large specific gravity such as stem cells remains in the container 20. Because the container 20 can easily be detached from the centrifuge, there is no need to perform an additional procedure of dividing separated layers according to specific gravity following the centrifugal separation, so that the required material can easily be obtained.

Figure 10:
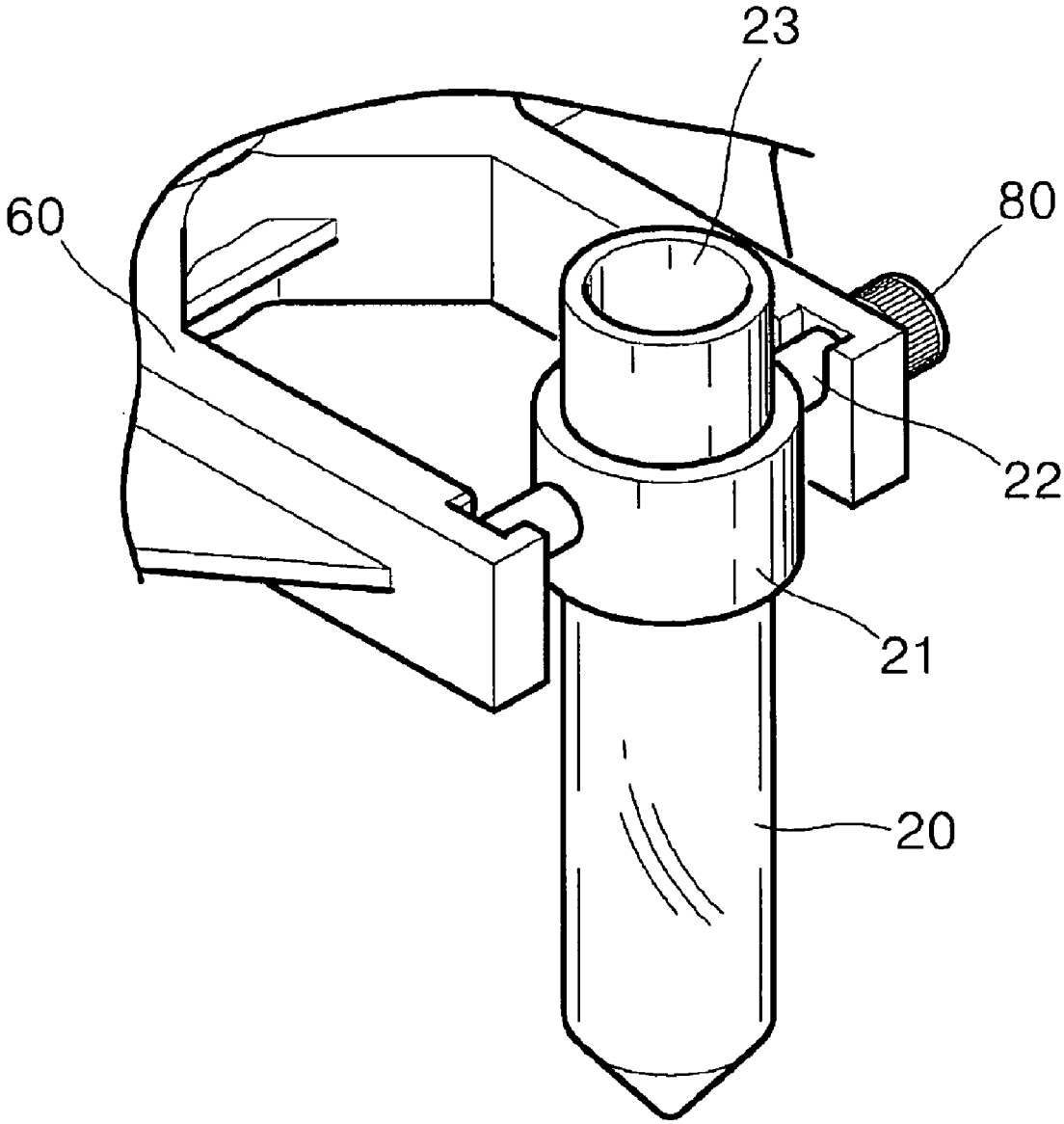
FIG. 10 is a perspective view of a portion of a centrifuge according to another embodiment of the present invention.

FIG. 10 is a perspective view of a portion of a centrifuge according to another embodiment of the present invention.

Because the overall structure and function of the centrifuge of the present embodiment is the same as those described above, only the differences therebetween will be described.

In the centrifuge of the present embodiment, the angle adjuster is altered. The angle adjuster performs the same function as in previous embodiments of adjusting the pivoting angle of the container 20 coupled pivotably to the rotor 60 that rotates about the rotation axis.

The angle adjuster includes a driving mechanism to forcibly pivot the pivoting axes 22 of the container 20. In the present embodiment, a rotation motor 80 is used as the driving mechanism; however, various alternate embodiments of the driving mechanism that can pivot the pivoting axes 22 of the container may be used.

The container 20 has an opening 23 formed at the top thereof, holds a material within, and is pivotably coupled to the rotor 60 with a pivoting holder 21 interposed therebetween. The pivoting holder 21 has a pivoting axis 22 formed thereon and the rotation motor 80 is coupled to the pivoting axis 22. Thus, the rotation motor 80 generates a driving force to the pivoting axis 22 of the pivoting holder 21 to adjust the pivoting angle of the container 20.

By adjusting the pivoting angle of the container 20 and controlling the rotation speed of the rotor 60, the centrifugal force applied to the material that has been centrifugally separated within the container 20 can be adjusted, so that the critical point at which each layer of centrifugally separated material can be discharged from the container 20 can be selected. Accordingly, after centrifugal separation, each of the remaining material layers in the container 20 may be selectively discharged to the outside.

Figure 11:
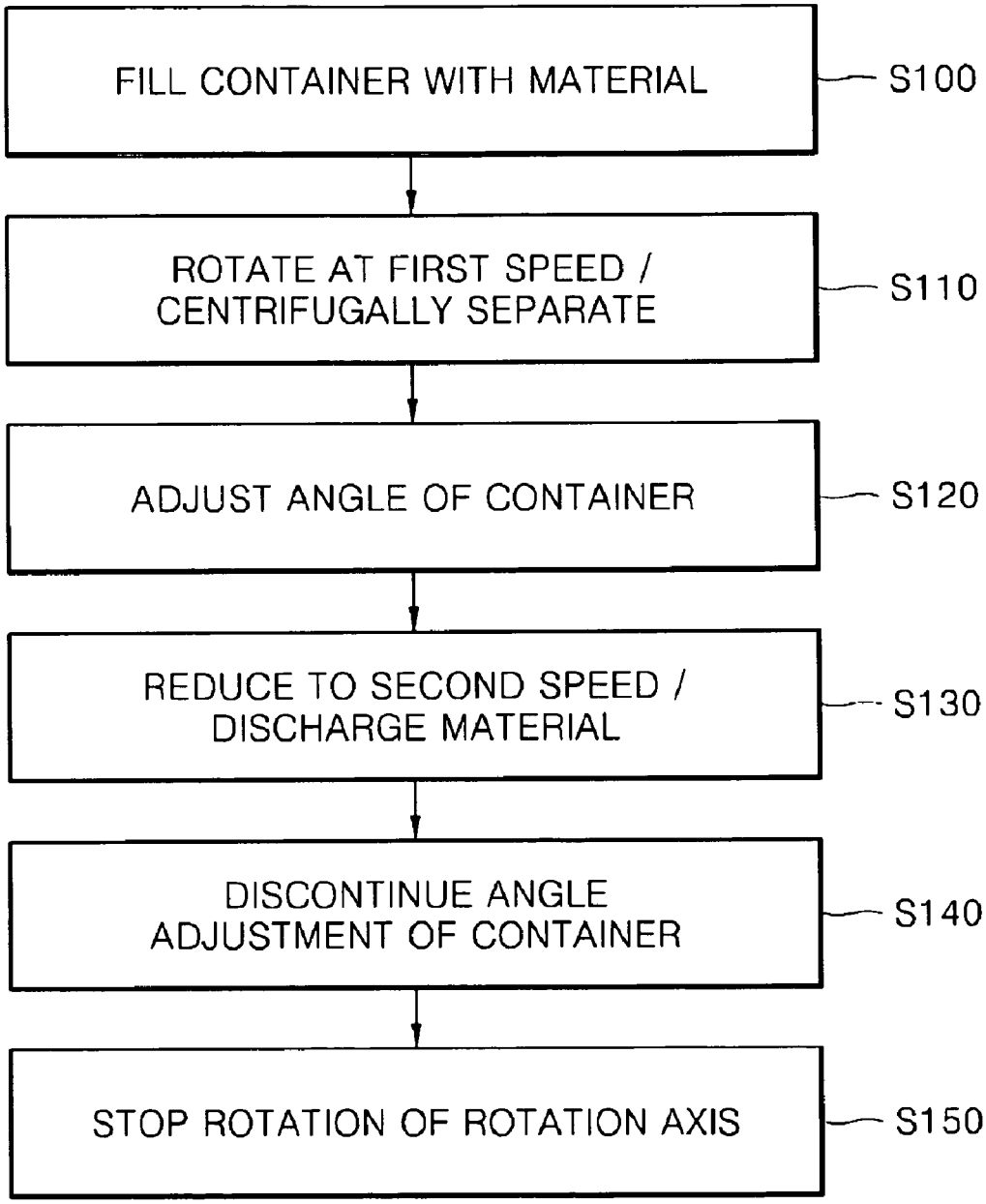
FIG. 11 is a flowchart of a centrifuging method according to an embodiment of the present invention.

FIG. 11 is a flowchart of a centrifuging method according to an embodiment of the present invention.

The centrifuging method of the present invention includes the following operations. In operation S100, a material is provided in a container that is capable of freely pivoting upward and downward on a pivoting axis about a vertical rotation plane. In operation S110, the rotation axis is rotated at a first speed to centrifugally separate the material in the container. In operation S120, while the rotation axis is rotating, the container is tilted so that the opening faces downward with respect to the rotation plane, and the opposite end faces upward with respect to the rotation plane, when the central axis of the container is disposed at an angle of between 90° and 180° with the rotation plane. In operation S130, the rotation speed is reduced from the first speed to a second speed, and a portion of the layers of material centrifugally separated within the container is discharged through the opening. In operation S140, the controlling of the tilt angle of the container with respect to the rotation center of the central axis is stopped so that the container returns through gravity to its original position with respect to the pivoting axis of its central axis. In operation S150, the rotation of the rotation axis is stopped.

In operation S130 of discharging a portion of the layers of material, an additional operation of filling the material discharged from the opening into a holding portion separate from the container may be added.

The container can easily be detached from the centrifuge so that only required material can be easily obtained without having to perform an additional process of dividing layers or dilution.

While the present invention has been particularly shown and described with reference to exemplary embodiments thereof, it will be understood by those of ordinary skill in the art that various changes in form and details may be made therein without departing from the spirit and scope of the present invention as defined by the following claims.

As described above, because the centrifuge of the present invention has a container that is coupled on a pivoting axis and capable of being pivoting upward or downward with respect to a vertical rotation plane to adjust its angle, so that after centrifugal separation is performed, respective layers of the separated material can be precisely and easily divided and recovered while centrifugal force is being applied.

The present invention relates to a centrifuge and a centrifuging method, and more particularly, to a centrifuge and a centrifuging method capable of performing centrifugal separating while simultaneously placing the opening of a container to face downward by raising the container by more that 90° about a pivoting axis so that accurate and easy recovery can be performed.

The centrifuge and the centrifuging method of the present invention may be used for all liquid and solid materials that can fall from a downwardly sloped surface through gravity, such as liquids, powders, jelly, liquid and solid compounds, colloids, and nearly spherical solids.

What is claimed is:

1. A centrifuge rotating about a rotation axis to separate a material, comprising:

a container coupled to the centrifuge to freely pivot upward and downward on a pivoting axis vertical to a rotation plane, the container having an opening at an upper end thereof and holding a material inside;

an angle adjuster raising a central axis of the container beyond a perpendicular angle with the rotation axis while the centrifuge is rotating in order to position the opening of the container downward with respect to the rotation plane and point an end of the container opposite to the opening upward with respect to the rotation plane, thereby allowing a portion of layers formed during centrifugal separation of the material to flow down through the opening and be discharged out of the container; and a casing surrounding the container and the angle adjuster, being fixed to rotatably support the rotation axis, and having a holding portion formed in the casing;

wherein the holding portion holds the material that flows down through the opening out of the container.

2. The centrifuge of claim 1, further comprising a rotation controller controlling a rotation speed of the centrifuge.

3. The centrifuge of claim 1, wherein the angle adjuster applies an external magnetic force to the container to adjust an angle of the container.

4. The centrifuge of claim 1, wherein the angle adjuster comprises a driving unit forcibly pivoting the pivoting axis of the container.

5. The centrifuge of claim 1, wherein the end of the container opposite to the opening is formed in a conical shape.

6. A centrifuge comprising:

a rotor rotating about a rotation axis;

a container coupled to the rotor to freely pivot upward and downward on a pivoting axis perpendicular to a rotation plane of the rotor, the container having an opening at an upper end thereof, holding a material inside, wherein the container rotates with the rotor about the rotation axis and pivots with respect to the rotation plane of the rotor about the pivoting axis; and an angle adjuster raising a central axis of the container beyond a perpendicular angle with the rotation axis while the rotor rotates in order to arrange the opening of the container downward with respect to the rotation plane and point an end of the container opposite to the opening upward with respect to the rotation plane, for allowing a portion of layers formed during centrifugal separation to flow down through the opening and be discharged out of the container, or lowering the central axis of the container from the raised position while the rotor rotates, wherein a holding portion is formed in the rotor, and the holding portion holds the material that flows down through the opening out of the container.

7. The centrifuge of claim 6, further comprising a rotation controller controlling a rotation speed of the rotor.

8. The centrifuge of claim 6, wherein the angle adjuster applies an external magnetic force to the container to adjust an angle of the container.

9. The centrifuge of claim 6, wherein the angle adjuster comprises a driving unit forcibly pivoting the pivoting axis of the container.

10. The centrifuge of claim 6, wherein the end of the container opposite to the opening is formed in a conical shape.

11. A method of centrifugal separation comprising:

providing a material within a container capable of pivoting freely upward and downward with respect to a rotation plane perpendicular to a rotation axis;

centrifugally separating the material through rotating the rotation axis at a first speed;

adjusting an angle between a central axis of the container and the rotation axis to be between 90° and 180° while the rotation axis is rotating at the first speed, such that an opening of the container faces downward with respect to the rotation plane, and an end opposite to the opening faces upward with respect to the rotation plane;

reducing the rotation speed from the first speed to a second speed after the centrifugal separating of the material and the adjusting of the angle, passing a portion of layers of material centrifugally separated within the container through the opening and discharging the portion of layers of material out of the container while the rotation axis is rotating at the second speed;

holding the material discharged out of the container in an holding portion that is disposed outside the container, wherein an angle of the holding portion with respect to the rotation plane perpendicular to the rotation axis is fixed;

discontinuing the adjusting of the angle between the central axis and the rotation axis, and restoring an original angle between the central axis and the rotation axis with effect of self-weight of the container; and stopping the rotation of the rotation axis.

12. The method of claim 11, wherein the discharging of the material further comprises loading material discharged from the opening into the holding portion.

* * * * *